US005421233A

United States Patent [19]

Bunker

[11] Patent Number: 5,421,233

[45] Date of Patent: Jun. 6, 1995

[54] ADJUSTABLE NECK DEVICE AND METHOD FOR STRINGED INSTRUMENTS

[76] Inventor: David L. Bunker, 12334 S. Pony Express Rd., Draper, Utah 84020

[21] Appl. No.: 183,669

[22] Filed: Jan. 19, 1994

[51] Int. Cl.[6] ..... G10D 3/00

[52] U.S. Cl. ..... 84/293

[58] Field of Search ..... 84/293; 74/89.15; 411/393, 410

[56] References Cited

U.S. PATENT DOCUMENTS

| | | | |
|---|---|---|---|
| 1,912,106 | 5/1933 | Turturro | 84/293 |
| 2,056,474 | 10/1936 | Low | 84/293 |
| 2,478,136 | 8/1949 | Stromberg | 84/293 |
| 2,998,742 | 9/1961 | Pratt | 84/293 |
| 3,159,072 | 12/1964 | Burns et al. | 84/293 |
| 3,196,730 | 7/1965 | Daniel | 84/293 |
| 3,251,257 | 5/1966 | Bunker | 84/267 |
| 3,396,284 | 8/1968 | Scherer | 310/8.3 |
| 3,418,876 | 12/1968 | Dopyera | 84/293 |
| 4,432,267 | 2/1984 | Feller | 84/293 |
| 4,557,174 | 12/1985 | Gressett, Jr. | 84/293 |
| 5,018,423 | 5/1991 | Bunker et al. | 84/293 |

FOREIGN PATENT DOCUMENTS

| | | | |
|---|---|---|---|
| 248509 | 2/1948 | Switzerland | 84/293 |

*Primary Examiner*—M. L. Gellner

*Assistant Examiner*—Eddie C. Lee

*Attorney, Agent, or Firm*—Thorpe, North & Western

[57] ABSTRACT

An adjustable, accessory neck member configured for interchangeable attachment to an instrument body as part of a stringed instrument. A neck body includes a top surface and an opposing back surface. A rigid, elongate bar is disposed within a channel formed within the neck body. An adjustment screw is rotatably engaged within an adjustment end of the rigid bar. A flange is attached to a first end of the screw and is sandwiched between the back surface of the neck and a mounting plate secured to said back surface. A small access hole is formed in the top surface in substantial alignment with the adjustment screw. A user inserts a screw turning device into the access hole to selectively rotate the screw. When the screw is rotated in a first direction, the back surface prevents movement of the screw in a first axial direction to thereby cause controlled displacement of the adjustment end of the bar in an opposing second axial direction. When the screw is rotated in an opposing second direction, the mounting plate prevents movement of the screw in the opposing second axial direction to thereby cause controlled displacement of the adjustment end of the bar in the first axial direction. The neck member is thereby adjustable independent of attachment to the instrument body.

12 Claims, 1 Drawing Sheet

ADJUSTABLE NECK DEVICE AND METHOD FOR STRINGED INSTRUMENTS

BACKGROUND OF THE INVENTION

1. Field of the Invention

The present invention relates to stringed instruments which include a neck and fingerboard extending the supported strings away from the body of the instrument. More particularly, the present invention relates to an accessory neck having a self-contained internal adjustment mechanism which is accessible from the fingerboard and further operable to adjust the neck independent of the neck being attached to the instrument body.

2. Prior Art

It is often desirable to adjust neck members in typical stringed instruments, such as guitars, in lateral and/or rotational directions. It is known to place a rigid adjustment bar within an enclosed channel in the neck, and selectively move the bar in lateral directions with an adjustment screw which is engaged within a female-threaded opening in one end of the bar. The adjustment screw is typically accessible through a hole in the back of the neck, which is reached by drilling a hole in the back of the guitar. Accessory neck members have been developed to incorporate such adjustment mechanisms and which are interchangeably attachable to different guitar bodies.

One of the motivating factors behind the development of accessory neck members was that the resulting guitar look as much like a conventional electric guitar as possible. Indeed, it is very difficult to get a performer to experiment with new instrument configurations. Musicians tend to hold to traditional designs which they know and trust. Accordingly, the adjustment mechanisms applied to conventional guitars either have been accessible from the ends of the neck or at the back of the guitar. This preserves traditional appearance.

As an example of long-time, traditional practice, the fingerboard has always been a continuous surface, free of holes or adjustment structure, and interrupted only by inlaid frets. It is doubtful that anyone has even considered disturbing the fingerboard with access holes or adjustment structure. Not only is it inconsistent with tradition, but is suggestion sounds impractical as a possible interference with performers' fingers. Further, the practices of the guitar industry have operated to bolster the feeling that the fretboard should be undisturbed and thus free from any adjustment apparatus or access ports therefore. This is clearly demonstrated by observation of the new guitar models that enter the market yearly without departing from this tradition. Accordingly, the accessory neck members remain adjustable only from the back and/or from the ends of the neck.

This is not to say that technical problems have been fully resolved by conventional design criteria. Adjusting the neck on stringed instruments such as guitars and banjos for example, and maintaining proper neck alignment, has been a challenge because a significant amount of force is continuously applied to the neck by a plurality of strings in tension. The spacing between the fingerboard and the strings must be consistent along the length of the neck. Such positioning is even more critical where frets are inlaid in the fingerboard to enable pitch selection of any selected string by depressing one or more fingers on a distal side of the fret from the resonating chamber or pickup part associated with the body of the stringed instrument. Although reference hereafter shall be made to an electric guitar, it will be apparent to those skilled in the art that the principles of this invention could be applied to other stringed instruments which share common construction design. Accordingly, further reference to the specific stringed instrument categorized as a guitar should be deemed to include other stringed instruments of comparable structure.

Proper alignment of the fingerboard of a guitar with respect to the suspended strings is essential. Although spacing and height displacement of strings from the fingerboard can be partially adjusted by the use of a specifically configured bridge or nut, it is preferred that the fingerboard of a guitar be straight and generally flat (meaning nontwisted) so that initial adjustments of the fingerboard position with respect to the rest of the instrument can be made in a predictable and controlled manner, remaining uniform for all frets along the fingerboard length.

In conventional fabrication of guitars, the neck member is often initially bowed or even twisted, if only slightly. Many of these faulty necks must be discarded. For some, adjustments can be made to properly position the fingerboard with respect to the strings. However, correction of subsequent rotational and/or lateral misalignments are very difficult where the fingerboard is not initially flat, and compensation is virtually impossible when attempted from the outset for an extreme bow or twisted neck structure.

It has been reported that as many as 60% of the carved wood neck components prepared in typical fabrication procedures are simply discarded where initial misalignment is detected. For example, even though an artisan may start with a piece of hard wood which is straight and true in its rough form, as sections of the hard wood are cut away to form the tapering neck body, existent stresses within the wood may cause its configuration to slightly bow or twist. Such misalignment is unacceptable in finer instruments and typically results in the component being discarded.

Even where the neck structure remains acceptable after initial tooling, when applied to the guitar and subjected to stringed forces of 175 to 200 pounds of compression, misalignment of the neck structure may result. Because of the unpredictable response of wood composition, guitar neck components cannot easily be prestressed to allow compensation for adjustments resulting from the described string pressure or loading which are imposed upon the neck.

Some adjustment has been facilitated by the use of a truss rod such as is illustrated in U.S. Pat. Nos. 3,396,621 and 4,557,174. The function of the truss rod is to redistribute loading forces imposed upon the neck to hopefully correct misalignment in the vertical bow which may occur with respect to the fingerboard and neck structure. It is important to note that the truss rod does not prevent loading of forces within the neck, but merely complements existing forces imposed by the strings with new forces to hopefully straighten or correct misalignment.

U.S. Pat. No. 4,432,267 illustrates a modular approach to providing for pre-strung adjustment in the neck component of the guitar by segmenting the neck and providing bolted attachment to the guitar body. Adjustment is accomplished by shifting the neck position with respect to the guitar body before tightening bolts which secure the neck to body orientation. This modular design has not provided the stability required for maintaining tuning nor for correcting other forms of misalignment. It is also cumbersome to adjust.

Furthermore, the prior problems of stress-imposed changes within the neck structure continue to be troublesome because forces arising from strings in tension can also affect distortion in the neck structure, particularly where weather conditions, heat and humidity might affect the wood. Therefore, a common impediment to construction and maintenance of a flat fingerboard and predictably straight neck body is the loading of the neck structure with the forces imposed by the tightly strung strings. Such stress is applied to the neck in conventional manner.

The disclosure of U.S. Pat. No. 3,251,257 ('257 patent) described the use of a rigid, metal bar for relieving string tension from the supporting neck and fingerboard structure. This disclosure explained that a rod could be inserted down a channel within the neck structure such that string tension applied at a distal end of the neck and fingerboard was loaded through the rigid bar into the guitar body. In this manner, the wood structure of the neck was not subjected to the severe tension and stress by reason of tightly drawn strings.

In addition, the '257 patent disclosed the use of a lifting force applied by contact of a threaded screw at the underside of the bar near the guitar body. For example, FIG. 2 of the '257 patent illustrates adjustment screw 39 which is mounted at a support plate 39' and has its distal end contacting within a notch at the underside of the bar. This permits tension to be applied at one side of the bar as the screw is rotated inward, thereby countering the tension applied to the strings 16. Accordingly, the '257 patent disclosed an adjustment mechanism which utilized the opposition of string tension versus bar tension in the vertical plane of the instrument to enable adjustment of the fingerboard and neck upward or downward. The limitations of such adjustment were controlled in part by the structural response of the neck material, the strings and string forces, and counter force established by the bar.

Although this mechanism provided improved adjustability along the vertical plane of the fingerboard, such adjustability was primarily limited to retracting the distal end of the fingerboard rearward by rotating the screw inward against the underside of the bar. Adjustments in the opposing direction were not as manageable because they depended upon the tension applied by the strings of the instrument. As guitar strings have become of lighter gauge, the difficulty of counter adjustments has increased. Furthermore, correction of misalignment was not possible without attachment of the strings. Therefore, modification of neck alignment at the manufacturer was limited.

In addition, the degree of abusive handling of instruments has greatly increased by virtue of modern performance styles, theatrics and attached hardware. For example, not only may a performance include swinging the guitar by its neck as part of performance choreography, but the use of tremolo bars and other hardware add greatly to the stress applied to the instrument, often resulting in misalignment of the fingerboard and neck structure.

An invention disclosed in U.S. Pat. No. 5,018,423 provides an adjustment mechanism for maintaining and/or correcting alignment of the fingerboard of a stringed instrument. Although this adjustment mechanism does not depend on string tension, some lateral adjustments require the support of the instrument body. Further, access to the adjustment mechanism is limited to entry from the back of the neck.

Although the collective approaches in the prior art have improved somewhat the state of the art in the field of stringed instruments, they are nonetheless fraught with disadvantages. Complete modularity of the neck member has still not been achieved, in that the neck member must be attached to the instrument body in order to be adjusted in all directions. This is because the adjustment mechanisms known in the art must be biased against the instrument body in order to impose displacement of the neck, at least in some directions. The pressure of the adjustment mechanism on the instrument body causes interior deformation in the instrument body, and the relative position of said adjustment mechanism and the body is often a source of unwanted vibration in the sound output of the instrument. Further, prior art adjustment mechanisms have not been accessible from the fingerboard side and have required that a hole be drilled in the back of the instrument body for access thereto. A further disadvantage is that adjusting the neck from the back side prevents the user from directly observing movement of the fretboard during the adjustment procedure.

OBJECTS AND SUMMARY OF THE INVENTION

It is accordingly an object of the present invention to provide an accessory neck member for stringed instruments which is interchangeably attachable to a string instrument body.

It is another object of the present invention to provide such a neck member which is adjustable in both lateral directions normal to the fingerboard and independent of attachment to the instrument body.

It is a further object of the present invention to provide such a neck member capable of isolating pressure in the adjustment apparatus from the instrument body.

It is an additional object of the present invention to provide such a neck member which can be adjusted without modification of the instrument body.

It is still another object of the present invention to provide such a neck member having adjustment apparatus which is easily and conveniently accessible from a top, fingerboard surface of the neck body.

The above objects and others not specifically recited are realized in a specific illustrative embodiment of an adjustable, accessory neck member configured for interchangeable attachment to an instrument body as part of a stringed instrument. A neck body includes a top surface and an opposing back surface. A rigid, elongate bar is disposed within a channel formed within the neck body. An adjustment screw is rotatably engaged within an adjustment end of the rigid bar. A flange is attached to a first end of the screw and is sandwiched between the back surface of the neck and a mounting plate secured to said back surface. A small access hole is formed in the top surface in substantial alignment with the adjustment screw. A user inserts a screw turning device into the access hole to selectively rotate the screw. When the screw is rotated in a first rotational direction, the back surface prevents movement of the screw in a first axial direction to thereby cause controlled displacement of the adjustment end of the bar in an opposing second axial direction. When the screw is rotated in an opposing second rotational direction, the mounting plate prevents movement of the screw in the opposing second axial direction to thereby cause controlled displacement of the adjustment end of the bar in the first axial direction. The neck member is thereby adjustable independent of attachment to the instrument body. The mounting plate prevents the adjustment apparatus from deforming interior portions of the instrument body, and from causing unwanted vibration in the sound output, and so forth.

The invention further includes utilization of a rotational biasing means which is coupled to the bar near its adjustment end and operable to apply rotational force to the bar about its axis to impose a degree of angular twist to the neck for adjustment purposes. Accordingly, both lateral and angular adjustment can be effected through applicational forces on a single bar which extends within the neck. The bar can be configured to bear most of the load of string tension applied to the instrument to inhibit deformation of the neck.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

DESCRIPTION OF DRAWINGS

The above and other objects, features and advantages of the invention will become apparent from a consideration of the subsequent detailed description presented in connection with the accompanying drawing in which.

DETAILED DESCRIPTION OF THE INVENTION

Figures 1, 2, 3, 4, 5:
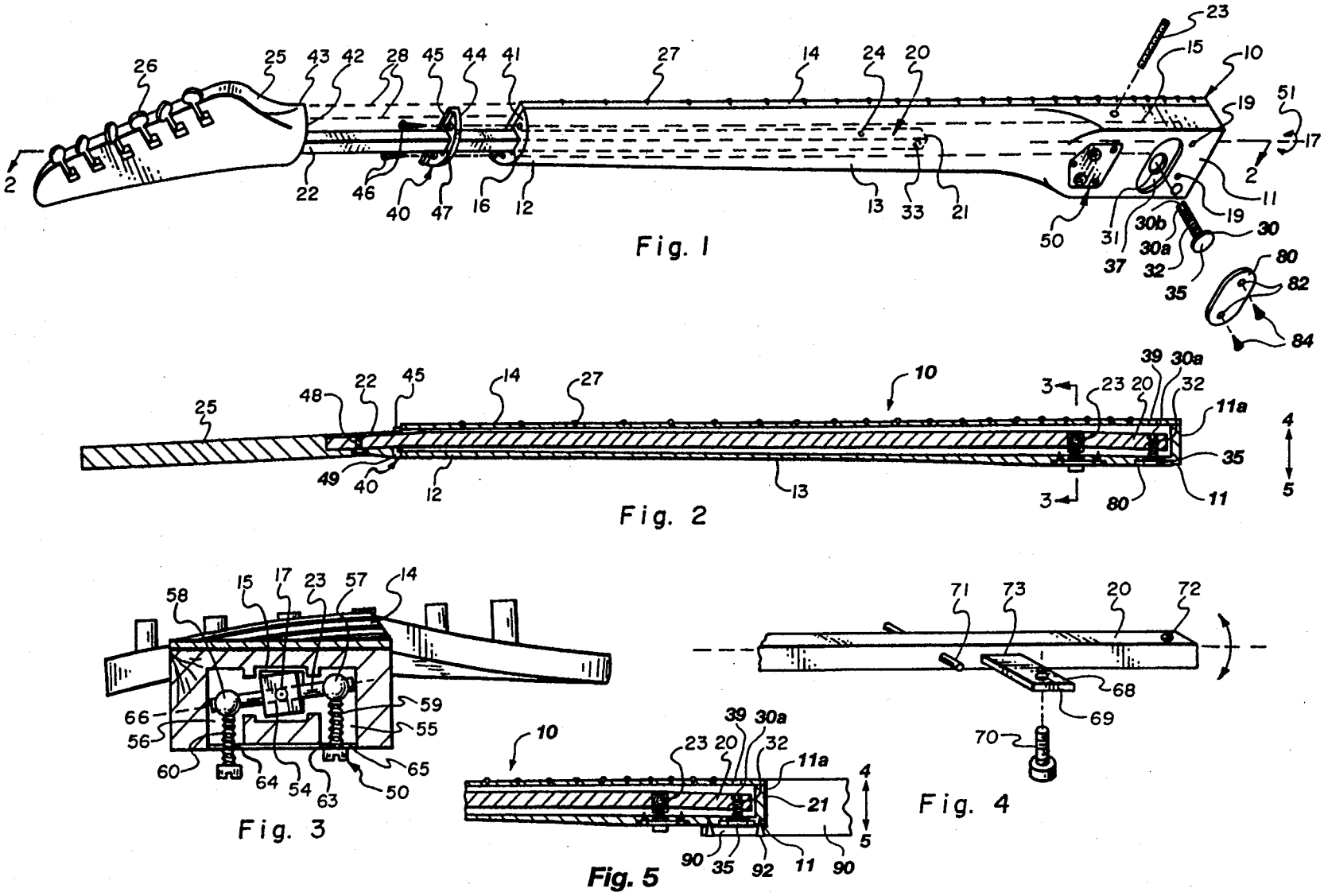
FIG. 1 shows a partially exploded, perspective view of an accessory neck/fingerboard member, made in accordance with the principles of the present invention, including a peg head for suspending strings of the instrument over the fingerboard.
FIG. 2 shows a cut away view taken along section 2—2 of FIG. 1.
FIG. 3 shows a cut away view taken along the lines 3—3 of FIG. 2, detailing rotational adjustment structure of the present invention.
FIG. 4 shows an alternate embodiment of the rotational structure illustrated in FIG. 3.
FIG. 5 shows a cut away view of the accessory neck/fingerboard member of FIG. 2, in conjunction with an instrument body and without a mounting plate.

Reference will now be made to the drawings wherein like structures will be provided with like reference numerals.

FIG. 1 shows a guitar neck, designated generally at 10, which includes a mounting end 11, a distal end 12, a fingerboard/top surface 14 and an opposing back surface 13. The phrase "fingerboard/top surface" as used herein refers to a top surface 14 of the neck 10, wherein said top surface 14 can be attached to a fingerboard or operate as a fingerboard itself. The back surface 13 includes a recessed portion formed therein to provide a flange mounting surface 37. Included within the neck is an enclosed channel 15 which extends from the mounting end 11 to an opening 16 at the distal end of the neck. This channel extends substantially along a central axis 17. The mounting end 11 includes openings 19 for screws to attach the neck to a guitar body (not shown in FIGS. 1–2).

A rigid bar 20 is disposed within the channel 15 and includes an adjustment end 21 which is to be positioned near the instrument body (not shown in FIGS. 1–2), a distal end 22, and a transverse pivot support 23 and support opening 24 within an intermediate section of bar 20. The distal end 22 of the bar 20 is rigidly attached to a peg head 25 which may include attendant tuning structure 26. This attachment is of a very sturdy nature to inhibit relative rotational movement or other relative displacement between the peg head 25 and the distal end 22 of the bar 20.

It should be noted that the described neck and peg head components may be fabricated of conventional material such as wood or plastics. However, it is preferred to make the neck from hard wood such as eastern maple or the like. Typically, the fingerboard is made of rose wood composition and frets 27 are of metal.

Strings 28 (shown in phantom line) as known in the art are held in tension between the peg head 25 and the instrument body (not shown in FIGS. 1–2). The bar 20 bears most of the compression imposed by the string tension in the strings 28, because of a tiny clearance space 49 separating the peg head 25 from a stabilizing plate 40 which is rigidly secured to the distal end 12 of the neck 10. It will be appreciated that because there is clearance space 49 between the peg head 25 and the plate 40, none of the neck 10 between the plate 40 and the pivot support 23 will be any of the load imposed by the string tension. Therefore, it is preferred that the bar 20 be made of rigid steel or other material capable of resisting such loads, and also of imposing adjustment forces appropriately within a neck structure. Cold rolled steel is a preferred material for the bar 20 because it maintains its orientation upon adjustment.

The preferred embodiment of the bar 20 illustrated herein is of rectangular configuration having height and width dimensions which provide a snug fit for its distal end 22 within the distal end 12 of the neck 10. This enables displacement of the distal end 22 of the bar 20 in opposing directions within a vertical plane substantially normal to the fingerboard/top surface 14, resulting in a corresponding displacement of the distal end 12 of the neck 10. This displacement is accomplished by a male-threaded screw 30 having a circular flange 35 coupled at a first end thereof. A threaded portion 32 of the screw 30 extends through an opening 31 in the flange mounting surface 37 so that said threaded portion 32 is engageable into a female-threaded opening 33 in the adjustment end 21 of the bar 20. The opening 31 is narrower than the flange 35 such that said flange 35 is rotatably sandwiched between the flange mounting surface 37 and a mounting plate 80. The mounting plate 80 is secured against the flange mounting surface 37 with one or more screws 84. This is illustrated more clearly in FIG. 2, showing a cross section of the assembled configuration.

It will be apparent that the screw 30 can be rotated clockwise or counterclockwise. A second end **30*a* of the screw 30 is accessible from a small access hole 39 formed in the fingerboard/top surface 14 of the neck 10. The access hole 39 preferably has a diameter within a range of approximately ⅛ of and inch and 3/16 of an inch, and is preferably positioned within approximately 0.5 inches of a mounting extremity 11*a* (FIG. 2). The second end 30*a* includes a hexagonal slot formed therein, or some other non-circular slot 30*b* defined by side walls as known in the art, such that the slot is configured to receive an allen-wrench or other screw-turning device. A user rotates the screw 30 by inserting a screw-turning device through the access hole 39 and into said slot formed in the second end 30***a* of said screw 30, and turning said screw 30 therewith.

It will be appreciated that the screw 30 will be retained in its relative position with respect to the neck 10 as shown in FIG. 2, while the coupled bar 20 will raise or lower, depending upon the direction of rotation of the threaded screw portion 32. This bi-directional displacement occurs about a pivotal support axis defined by the transverse pivot support 23 which provides a fulcrum position for the adjustable bar 20. When the screw 30 is rotated in a first direction, the flange mounting surface 37 operates as a restraining means and prevents movement of said screw 30 in a first axial direction 4 to thereby cause controlled displacement of the adjustment end 21 of the bar 20 in an opposing second axial direction 5. When the screw 30 is rotated in an opposing second rotational direction, the mounting plate 80 operates as a restraining means and prevents movement of said screw 30 in the opposing second axial direction 5 to thereby cause controlled displacement of the adjustment end 21 of the bar 20 in the first axial direction 4. It will be appreciated that the mounting plate 80 operates to prevent the screw 30 from contacting the instrument body (not shown in FIGS. 1–2) when the neck 10 is attached to said instrument body. The mounting plate 80 receives pressure from the screw 30 and distributes said pressure into the neck 10, to thereby substantially isolate any such pressure from the instrument body.

It will be appreciated that the features and aspects discussed above provide a number of significant advantages. The pressure isolation provided by the mounting plate 80 permits the neck 10 to be adjusted in either of the directions 4 or 5 without being attached to the instrument body (not shown in FIGS. 1–2). The plate 80 prevents contact between the screw 30 and the instrument body, thereby inhibiting denting or other deformation of said instrument body. Such deformation is often required when adjusting the neck in prior art guitars since the body provides pressure support to the screw 30 in some cases, resulting in decreased sound quality and/or user dissatisfaction. The pressure-isolating, self-contained nature of the neck 10 and its adjustment apparatus results in a tighter, more firmly-connected instrument which appeals to the user in terms of better tone quality of the sound output, and a tighter feel.

A further advantage results in cases when a shim is placed between the guitar body and the neck 10 as known in the art to move the neck 10 closer to the strings 28. A "shim" simply refers to a small piece of wood, cardboard or the like. This practice results in what are referred to in the art as "dead spots", or spacing between the body and the neck 10 on one or both sides of the shim. The adjustment screw 30 can cause unwanted vibrations or other disturbance in the sound output of the instrument when positioned in certain areas of such dead spots. In some cases, the user must choose between the unwanted sound disturbance, or an imperfect adjustment of the neck 10, when the desired adjustment results in placement of the flange end 35 in a sound-trouble area of a dead spot. Since the mounting plate 80 of the present invention prevents any part of the screw 30 from venturing beyond the back surface 13 of the neck 10, this sound disturbance problem is avoided.

The accessibility to the screw 30 from the access hole 39 in the top surface 13 is also significant. In prior art guitars, the neck portion must be attached to the instrument body in order to adjust the neck, because the body provides necessary pressure to the screw 30 when displacing the adjustment end 21 of the bar 20 in the direction 4. Further, adjustment apparatus in prior art guitars has been accessible only from the back surface 13. The user must drill a hole through the back of the guitar which is smaller than the flange 35 in order to gain access to the screw 30 and maintain contact between the flange 35 and the body. Guitars often have a valuable trademark plate attached to the back surface of the body which also must be penetrated in order to gain access to the screw 30 in the manner described. The access hole 39 thus renders unnecessary any modification of the instrument body in order to adjust the neck 10 in the directions 4 and/or 5. Thus, the instrument body 90 (FIG. 5) can be used as a restraining means to prevent movement of the screw 30 in the opposing second axial direction 5, with the screw 30 being accessible from the access hole 39. These aspects are especially advantageous in the case of acoustic guitars, wherein modification for adjustment purposes is often particularly undesirable because entry at the back of the guitar requires drilling a hole through the sound plate. The small size of the access hole 39 and its adjacent position relative to the mounting extremity 11*a* render it virtually unnoticeable and substantially removed from the main fingering area of the fingerboard/top surface 14. A further advantage of the access hole 39 is that the user can observe movement of the neck 10 during the adjustment procedure, making adjustments easier and quicker.

An additional feature in accordance with the present invention is the uniquely designed stabilizing plate 40 which rigidly ties the peg head 25 to the distal end 12 of the neck 10. This stabilizing plate 40 is positioned between mounting support faces 41 and 42 at juxtaposed ends of the neck and peg heads respectively. This support face 43 of the peg head 25 includes an adjacent planar shoulder 43 at an upper edge therefore for abutting at a corresponding portion of the mounting support face 41 of the neck 10. This rigid stabilizing plate 40 includes a plate member 44 and a locking flange 45 approximately normal to the plate 44. The dimensions of the plate and locking flange are such that the flange 45 barely projects over the shoulder 43 of the peg head. This is more clearly illustrated in FIG. 2, where the flange 45 is illustrated in its locking position over the shoulder 43 of the peg head 25.

Because the plate member 40 is firmly secured to the face 41 of the neck by screws 46, the stabilizing plate 40 is immovable with respect to the neck 10. The locking flange 45 secures the peg head 25 against rotation, based on the close contact of the flange 45 and shoulder 43. This contact is maintained by proper dimensioning of a plate opening 47 in the plate member 44 which corresponds in configuration to a cross section of the bar 22. This opening is aligned with the axis 17 of the bar such that the close fit of the bar opening 47 and the abutment of shoulder 43 against the locking flange 45 make the separable members of the neck and peg head (with bar coupled within the head by screw 48) immovable.

This locking plate 40 may be fabricated of various rigid materials such as high strength polymer and reinforcement fiber, and metals of various types. For example, aluminum and brass are both easily tooled or formed into the appropriate plate configuration. It should be noted that the selection of materials directly affects the nature of tone developed by the instrument. Utilization of a brass stabilizing plate develops a brighter sound with higher harmonics and timbre. In contrast, reinforced composite material tends to dampen the sound and generate a more subdued or dark timbre. High tensile polymers such as KEVLAR (TM) fall in the midrange, with aluminum providing a response more toward the brighter sound of the brass plate. The variety of sound and ability to control tonal quality by selection of various compositions for the stabilizing plate 40 is an unexpected benefit developed by virtue of the combination of the components provided in the present invention.

Additional adjustment capabilities are provided by the present invention in a rotational biasing means 50 which enables rotational adjustment 51 about the bar axis 17, complementing the upward and downward adjustment enabled by the threaded member 30. This rotational biasing means 50 is coupled to the bar near its adjustment end 15 and operates to apply a rotational force 51 along the bar to thereby impose a degree of angular twist to the neck. This aspect of the invention is more clearly illustrated in FIG. 3.

FIG. 3 illustrates one embodiment of the rotational biasing means 50 wherein means are provided for imposing angular displacement to the transverse pivot support 23 which operates as a fulcrum point for vertical adjustment of the bar. In this embodiment, the pin 23 is dimensioned to fit closely within the traverse opening 54 at the pivot of the bar. Channels 55 and 56 are cut into the neck structure and communicate with the bar channel 15. Opposing ends of the pin 23 extend to each of these channels and interlock with an annular receiving member 57 and 58 wherein the annulus receives the distal ends of the pin 23. Each receiving member 57 and 58 is coupled to a biasing screw 59 and 60 which is threaded and journaled in a threaded opening 63 and 64 of a rigid mounting plate 65.

Operation of the rotational biasing means is accomplished by counter rotation of the respective biasing at opposing ends of the pin 23, causing the pin to twist about the axis 17 of the bar. This loads a rotational force on the bar 20 along its length, causing the more narrow portion of the neck 12 to twist in the manner illustrated in FIG. 3. In this figure, the fingerboard/top surface 14 is shown twisted in a counter clockwise direction in response to the respective raised 59 and lowered 60 biasing screws. It will be apparent to those skilled in the art that this figure is greatly exaggerated and that the degree of twist actually opposed would barely be perceptible to the human eye. Accordingly, FIG. 3 has rotational movements which are greatly enhanced.

The use of two biasing screws 59 and 60 in FIG. 3 assist in stabilizing the rotated bar in a fixed position. For example, a single biasing screw in the illustrated configuration would permit the bar 20 to shift somewhat, depending upon the amount of channel space 15 available. The two biasing screws 59 and 60 cooperate to fix the relative position of the pin axis 66 and the bar axis 17 so that an adjustment which is made to the fingerboard remains fixed and stable.

FIG. 4 illustrates an additional example of a means for biasing the bar 20 to a rotated configuration with results similar to those shown in FIG. 3. Specifically, this embodiment includes a lateral tab 68 having a threaded opening 69 for receiving a bias screw 70. This bias screw 70 would be secured through a plate 65 as shown in FIG. 3. An advantage of the latter embodiment is its displacement from the pivot pin 71 which is utilized to provide the vertical displacement associated with threaded opening 72, as illustrated in FIG. 2 with item 30. The tab is adjusted upward or downward to impose appropriate rotation and provides the desired stability because of its rigid attachment 73 to the bar. Such attachment may be by welding or other permanent fixation.

Each structural feature is generally representative of a general method for bi-directional control of adjustment of the neck and fingerboard at any given plane of a stringed instrument. For example, vertical adjustment of the neck 10 (adjustment in directions 4 and 5) occurs within a plane which is normal to the fingerboard and coplanar with the axis of the bar. Rotational adjustment of the neck 10 occurs within a plane which is normal to the axis of the bar (forming a cross section in the bar and neck). The actual steps of the inventive method are applied with respect to an instrument which includes a rigid bar disposed within a channel as previously described herein, located within the neck and extending along the length of the neck as is shown in FIG. 2.

The method is practiced by providing a close dimensional fit between the distal end 22 of the bar 20 and the distal end of the channel 15 such that bi-directional displacement of said distal end 22 along the rotational or vertical axis results in a corresponding displacement of the distal end 12 of the neck 10. Put another way, forces applied to the bar 20 are transferred from the side walls of the channel 15 such that the neck 10 becomes bent or twisted accordingly.

A second step of this method involves coupling a bi-directional, threaded adjustment mechanism (previously described as either item 30 or item 50) to the adjustment end of the bar, and then rotating and/or counter rotating this threaded adjustment mechanism to impose bi-directional displacement forces therefrom to the distal end 22 of the bar 20.

More specifically, vertical adjustment is accomplished by coupling the threaded adjustment mechanism through a threaded opening 33 in the adjustment end 21 of the bar 20 and rotating the adjustment mechanism clockwise or counter clockwise to enable the desired vertical adjustment in either upward or downward directions. Rotational adjustment is similarly accomplished by coupling the threaded adjustment mechanism to the adjustment end 21 of the bar 20 in tangential, offset relationship with the bar axis and then rotating the mechanism to apply rotational force to the bar 20.

The advantages of the present invention in broad context extend from initial stages of construction, up through the final use of the instrument in actual performance. For example, the various adjustments available with the present invention enable greater utility for necks which may be deformed in fabrication procedures. Instead of throwing the neck away, vertical or rotational adjustments are applied after assembly to straighten the neck 10 to a proper orientation. A major advantage of the present invention is that such adjustments can be made without attaching the neck 10 to the instrument body, as has been required by prior art structures and methods. The present invention permits bi-directional adjustment in both directions 4 and 5, and in rotational and counter rotational orientation without strings, trusses of other exterior forces. Furthermore, because the bar 20 is tied into the guitar body with full adjustment capability, much improved retention of tuning pitches is provided, despite the most heavy application of tremolo and other rough forms of treatment.

The present invention even permits greater versatility in finish work on the instrument and enhanced capability for extended warranty. For example, whereas prior instruments were seldom warranted unless the neck was totally sealed by varnish or other finishes from the effects of humidity and weather, the present instrument does not require such a finish. If slight deflection occurs because of weather conditions, or even abuse, the neck can be straightened by making appropriate vertical and rotational adjustments to the bar which carries the dominant load of force imposed by the guitar strings. This mechanism therefor enables extended warranties which can be honored by merely making adjustments within the neck adjustment structure. These are only a few of the examples and benefits that arise because of this greatly advanced adjustment mechanism.

The present invention represents a significant advance in the field of accessory necks in stringed instruments. It is noted that many, but not all, of the advantages of the present invention result from the access hole 39 in the fingerboard/top surface 14, and from the support plate 80. The provision of the access hole 39 in the top surface 14 provides the advantages that a user can replace or adjust the neck 10 without modifying the instrument body and need not purchase a new trademark plate after having drilled a hole through it. The user can observe movement of the neck 10 during the adjustment procedure by accessing the screw 30 from the access hole 39. It will be appreciated that when the access hole 39 is very small (between ⅛ of an inch and 3/16 of an inch) and located within about 0.5 inches of the extremity 11*a*, it is substantially unnoticeable to the user and does not disturb the fingerboard/top surface 14 or irritate the user.

The plate 80 isolates pressure in the screw 30 from the instrument body, preventing deformation of the body and disturbance of the sound output. The plate 80 allows the neck 10 to be adjusted independent of attachment to the instrument body. The problems associated with the prior art accessory neck members and neck adjustment structures are overcome to a significant degree by the present invention. Those skilled in the art will appreciate from the preceding disclosure that the objectives stated above are advantageously achieved by the present invention.

It is to be understood that the principles in accordance with the present invention can be applied to non-accessory neck members in stringed instruments. Put another way, the neck members need not be interchangeable but can be permanently attached to the body. Further, the invention can be applied to acoustic and electric stringed instruments alike. It is to be understood that the above-described arrangements are only illustrative of the application of the principles of the present invention. Numerous modifications and alternative arrangements may be devised by those skilled in the art without departing from the spirit and scope of the present invention. For example, the rigid bar 20 need not be attached to the peg head 25; although the neck 10 would then bear the string tension, the advantages provided by the access hole 39 and support plate 80 can occur with a rigid bar 20 which only extends along a portion of the channel 15. Further, the cross sections of the channel 15 and the rigid bar 20 need not be square, but may alternatively be of any non-circular shape in order to provide the cooperative engagement therebetween as described above.

It is further to be understood that the advantages provided by the support plate 80 can be obtained without provision of the access hole 39. For example, the plate 80 could be provided with an access hole smaller than the flange 35, in which case a screw turning device would turn the screw 30 from the flange end 35 instead of from the second end 30*a*. The advantages of pressure isolation from the body, and adjustability independent of attachment to the body, would still be obtained without the access hole 39.

Further, the advantages provided by the access hole 39 can be obtained without provision of the support plate 80. Although the screw 30 would require the support of the body for adjustment of the neck 10 in direction 5, the adjustments could be made while observing the movement of the neck 10, and without modification to the body.

Numerous other modifications and arrangements not specifically mentioned herein are within the scope of the present invention, and the appended claims are intended to cover such modifications and arrangements.

It will be apparent to those skilled in the art that these methods can be practiced with respect to stringed instruments of a variety of construction and that the specific structure disclosed in this description is merely exemplary of several preferred embodiment thereof. Accordingly, it is to be understood that the claims are not to be limited by the specific examples provided herein, but are to be construed in accordance with the following claims.

What is claimed is:

1. An adjustable neck member configured for attachment to an instrument body portion as part of a stringed instrument, said neck member comprising:

an elongate neck body having (i) a fingerboard/top surface, (ii) an access hole formed in said top surface, (iii) a mounting end attachable to the instrument body, and (iv) an enclosed elongate channel formed within said neck body in a substantial parallel orientation with a central axis of said neck body;

an elongate, rigid bar disposed within the channel, said bar having (i) an adjustment end, (ii) an opposing distal end, and (iii) a pivot support disposed on said bar between said adjustment end and said distal end, said pivot support being journaled within the neck body to thereby enable said bar to pivot about said pivot support relative to the neck body such that displacement of said distal end results in a corresponding displacement of a portion of the neck body; and adjustment means coupled to the adjustment end of the bar and being accessible from the access hole for selectively adjusting/displacing said adjustment end in opposing directions within a vertical plane substantially normal to the top surface of the neck body, to thereby cause the bar to pivot about the pivot support such that the distal end of said bar is correspondingly displaced within said vertical plane in opposing directions relative to the displacement of said adjustment end, resulting in said corresponding displacement of said portion of the neck body;

wherein the adjustment end of the bar includes a female-threaded opening having an axis in a substantially normal orientation relative to the top surface of the neck body, said adjustment means comprising:

a male-threaded screw rotationally mounted within the female-threaded opening; and restraining means for restraining the male-threaded screw from axial movement such that rotation of the screw within said female-threaded opening of the bar causes a controlled displacement of the adjustment end of said bar along an axis of said screw and an opposing pivotal displacement of the distal end of said bar;

wherein the screw is substantially aligned with the access hole such that an opposing second end of the screw is accessible from said access hole, said second end having means disposed thereon for enabling rotational movement of said screw;

wherein the back surface of the neck body includes a flange mounting surface having an aperture formed therein in substantial alignment with the screw, the restraining means including:

a flange coupled at a first end of the screw and being rotatably positioned between the flange mounting surface and the instrument body such that the screw extends from the first end of said screw through the aperture and into the female-threaded opening to a second end of said screw, such that:

(i) when the screw is rotated in a first rotational direction, the flange mounting surface prevents movement of the screw in a first axial direction to thereby cause controlled displacement of the adjustment end of the bar in an opposing second axial direction, and (ii) when the screw is rotated in an opposing second rotational direction, the instrument body prevents movement of the screw in the opposing second axial direction to thereby cause controlled displacement of the adjustment end of the bar in the first axial direction.

2. A neck member as defined in claim 1 wherein the access hole has a substantially circular shape and a diameter within a range of approximately ⅛ of an inch to 3/16 of an inch, and wherein a center of said access hole is positioned within approximately 0.5 inches of the mounting end of the neck body.

3. An adjustable neck member configured for attachment to an instrument body portion as part of a stringed instrument, said neck member comprising:

an elongate neck body having (i) a fingerboard/top surface, (ii) an opposing back surface, (iii) a mounting end attachable to the instrument body, and (iv) an enclosed elongate channel formed within said neck body in a substantial parallel orientation with a central axis of said neck body;

an elongate, rigid bar disposed within the channel, said bar having (i) an adjustment end, (ii) an opposing distal end, and (iii) a pivot support disposed on said bar between said adjustment end and said distal end, said pivot support being journaled within the neck body to thereby enable said bar to pivot about said pivot support relative to the neck body such that displacement of said distal end results in a corresponding displacement of a portion of the neck body;

adjustment means coupled to the adjustment end of the bar for selectively adjusting/displacing said adjustment end in opposing directions within a vertical plane substantially normal to the top surface of the neck body, to thereby cause the bar to pivot about the pivot support such that the distal end of said bar is correspondingly displaced within said vertical plane in opposing directions relative to the displacement of said adjustment end, resulting in said corresponding displacement of said portion of the neck body; and pressure-isolating means disposed on the back surface of the neck body in substantial alignment with the adjustment means, for restraining said adjustment means against axial movement to thereby (i) prevent said adjustment means from contacting the instrument body, and (ii) receive pressure from said adjustment means and isolate said pressure from the instrument body;

wherein the adjustment end of the bar includes a female-threaded opening having an axis in a substantially normal orientation relative to the top surface of the neck body, said adjustment means comprising:

a male-threaded screw rotationally mounted within the female-threaded opening; and restraining means for restraining the male-threaded screw from axial movement such that rotation of the screw within said female-threaded opening of the bar causes a controlled displacement of the adjustment end of said bar along an axis of said screw and an opposing pivotal displacement of the distal end of said bar;

wherein the back surface of the neck body includes a flange mounting surface having an aperture formed therein in substantial alignment with the screw, the restraining means including:

a flange coupled at a first end of the screw and being rotatably sandwiched between the flange mounting surface and the pressure-isolating means such that the screw extends from the first end of said screw through the aperture and into the female-threaded opening to a second end of said screw, such that:

(i) when the screw is rotated in a first rotational direction, the flange mounting surface prevents movement of the screw in a first axial direction to thereby cause controlled displacement of the adjustment end of the bar in an opposing second axial direction, and (ii) when the screw is rotated in an opposing second rotational direction, the pressure-isolating means prevents movement of the screw in the opposing second axial direction to thereby cause controlled displacement of the adjustment end of the bar in the first axial direction.

4. A neck member as defined in claim 3, wherein the neck body includes an access hole formed in the top surface thereof, such that the adjustment means is accessible from said access hole.

5. A neck member as defined in claim 3 wherein dimensions of a cross-section of the bar near the distal end thereof correspond with dimensions of a cross-section of the channel to thereby provide a snug fit for said distal end between walls of the channel to thereby enhance said corresponding displacement of said portion of the neck body resulting from said displacement of the distal end of said bar.

6. A neck member as defined in claim 3 wherein the pressure-isolating means comprises:

a mounting plate; and securing means for securing the mounting plate against the flange mounting surface of the neck body.

7. A neck member as defined in claim 6 wherein the securing means comprises one or more screws intercoupling the mounting plate against the flange mounting surface of the neck body.

8. A neck member as defined in claim 3 wherein a distal section of the rigid bar and a corresponding section of the elongate channel have substantially similar non-circular cross sections, the cross section of said corresponding section of the channel configured and sized to restrain rotational movement of the distal end of the bar relative to the neck body.

9. A neck member as defined in claim 8, further comprising rotational biasing means coupled to the rigid bar and operable for selectively applying a rotational force to the bar about an axis of said bar to impose a degree of angular twist to the neck body, to thereby selectively adjust at least a portion of the neck in an angular direction relative to a long axis of the neck.

10. A neck member as defined in claim 9, wherein the rotational biasing means comprises:

the pivot support, said pivot support comprising a pin dimensioned to fit snugly within a transverse opening in a pivot point of the bar, the neck body including a first female-threaded channel positioned in substantial alignment with a first end of said pin; and a first male-threaded biasing screw engaged within the first female-threaded channel and having a distal tip contacting the first end of the pin to thereby provide selective rotational adjustment of the pin upon rotation of said first screw, to thereby apply said rotational force to the bar.

11. A neck member as defined in claim 10 wherein the neck body includes a second female-threaded channel positioned in substantial alignment with an opposing second end of said pin such that said first and second channels are positioned on opposing sides of the pivot point in the bar, the rotational biasing means further comprising:

a second male-threaded biasing screw engaged within the second female-threaded channel and having a distal tip contacting the second end of the pin to thereby provide a counter-force mechanism applied at the opposing first and second ends of the pin for stabilizing the bar at a selected degree of rotational twist about a long axis of said bar.

12. A neck member as defined in claim 9, wherein the rotational biasing means comprises:

a lateral tab coupled to the bar, the neck body including a channel positioned laterally adjacent to the bar and configured for housing the tab with sufficient clearance for the tab to be displaced therein; and a male-threaded biasing screw disposed within a female-threaded channel positioned in substantial alignment with a distal end of the lateral tab, such that rotation of the screw causes said screw to move into contact with the lateral tab to thereby displace said tab and impose a degree of angular twist to the bar about a long axis of said bar.

* * * * *